US006146219A

United States Patent [19]

Blanchard

[11] Patent Number: 6,146,219

[45] Date of Patent: Nov. 14, 2000

[54] REVERSE PROPULSION AND CONTROL MEANS FOR WATER JET POWERED BOATS

[75] Inventor: Clarence E. Blanchard, Pleasant Prairie, Wis.

[73] Assignee: Outboard Marine Corporation, Waukegan, Ill.

[21] Appl. No.: 09/265,072

[22] Filed: Mar. 9, 1999

[51] Int. Cl.[7] ..... B63H 25/46

[52] U.S. Cl. ..... 440/40; 114/151; 440/38; 440/41

[58] Field of Search ..... 440/47, 38, 40, 440/41; 114/148, 151

[56] References Cited

U.S. PATENT DOCUMENTS

| | | | |
|---|---|---|---|
| 3,078,661 | 2/1963 | Spence | 60/35.54 |
| 3,137,266 | 6/1964 | Perrier et al. | 114/151 |
| 3,339,516 | 9/1967 | Lenci | 115/12 |
| 3,384,047 | 5/1968 | Remley | 115/1 |
| 3,613,630 | 10/1971 | Jacuzzi | 115/12 R |
| 3,675,611 | 7/1972 | Glass | 115/12 R |
| 3,680,315 | 8/1972 | Aschauer et al. | 60/221 |
| 4,056,073 | 11/1977 | Dashew et al. | 114/151 |
| 4,214,544 | 7/1980 | Dashew et al. | 114/151 |
| 4,265,192 | 5/1981 | Dunn | 114/151 |
| 4,807,552 | 2/1989 | Fowler | 114/151 |
| 5,129,846 | 7/1992 | Dimijian | 440/40 |
| 5,472,359 | 12/1995 | Allbright, Jr. et al. | 440/38 |
| 5,720,636 | 2/1998 | Burg | 440/41 |

*Primary Examiner*—S. Joseph Morano
*Assistant Examiner*—Lars A. Olson
*Attorney, Agent, or Firm*—John H. Pilarski

[57] ABSTRACT

A simple and efficient reverse propulsion and control means for water jet powered boats which includes a sliding water valve for controlling exhaust thrusters mounted around the peripheral of the boat and which is coordinated with pivotal movement of the main thruster nozzle.

20 Claims, 4 Drawing Sheets

REVERSE PROPULSION AND CONTROL MEANS FOR WATER JET POWERED BOATS

BACKGROUND OF THE INVENTION

1. Field of the Invention

The present invention relates to propulsion and control apparatus for marine craft and particularly to primary steering control coordinated with a single slide valve for controlling water flow to waterjet thruster apparatus to provide reverse propulsion and control for water jet powered boats.

2. Description of Related Art Including Information Disclosed Under 37 CFR 1.97 and 1.98

The use of a waterjet as a primary propulsion system for marine craft is not new. Water jet thrusters for more precise maneuvering primarily during docking and leaving a dock is a more recent development, but still has been around for a long time. However, as will be seen from the following examples of the prior art, the primary propulsion system and the more precise maneuvering systems of marine vessels have typically been developed as separate and distinct systems.

U.S. Pat. No. 3,078,661 issued to H. U. Spence on Feb. 26, 1993, discloses a jet propulsion drive that is connected to a conduit leading to a control valve which control valve controls flow to port and starboard side thrusters. The side thrusters are controlled by butterfly valves which are moved in response to movement of a control lever or joy stick. More specifically, lateral movement of the joy stick affects or controls the position of the valve. The control of the valve is independent of the steering operation in that the steering wheel is connected by linkage to steering vanes.

U.S. Pat. No. 3,102,389 issued to G. H. Pedersen et al. on Sep. 3, 1963, discloses a marine vessel wherein a jet propulsion drive includes a valve which moves between an upper and a lower position. When the valve is in the upper position the water flows out of the jet nozzle and drives the boat forward. When the valve is in the lower position water flows into an upper conduit which leads to side branches. These side branches may be selectively opened or closed by controlling a control vane.

U.S. Pat. No. 3,339,516 issued to V. Lenci on Sep. 5, 1967, discloses a marine vessel having a jet propulsion drive connected to a rearward outlet riser or conduit which is connected to a loop having a plurality of side pipes and a forward riser. The side pipes and risers are all for firefighting streams of water.

U.S. Pat. No. 3,613,630 issued to Frank Jacuzzi on Oct. 19, 1971, discloses a marine vessel having a jet propulsion drive which further includes a pressure hose line intended to supply a fire nozzle.

U.S. Pat. No. 3,675,611 issued to John P. Glass on Jul. 11, 1972, uses the marine vessel engine to drive both the boat's water screw primary propeller system and a water pump connected to a plurality of water jet nozzles mounted at the bow and stern of the boat to assist in steering during docking. The water jet nozzles also provide axillary drive to propel the boat at slow speeds. A pump supplies water to the water jet nozzles, and a control mechanism operates the valves to move the boat forward, aft, sideways, and to rotate it clockwise and counterclockwise.

U.S. Pat. No. 3,680,315 issued to George R. Aschauser et al. on Aug. 1, 1972, discloses a marine vessel using water jet propulsion through a main thrust nozzle as the primary power source for forward and reverse movement. Side vector valves which are arranged to provide full water pressure are available for providing steering functions regardless of the position of the main thrust nozzle (i.e., forward or reverse).

U.S. Pat. No. 4,265,192 issued to Garf L. Dunn on Feb. 5, 1979, discloses a typical hydraulic pump drive thrust and maneuvering system which is operated by a selected combination of a plurality of water control valves from a central control switch unit. The controls of the water thruster valves is independent of any other steering of the vessel.

U.S. Pat. No. 4,807,552 issued to Larrie M. Fowler on Feb. 28, 1989, discloses port and starboard discharge nozzles by means of a bidirectional positive displacement pump for controlling a small boat. The positive displacement pump simply turns in one direction to provide water flow in a direction to achieve starboard movement and the other direction to provide water flow in the opposite direction to achieve port movement.

U.S. Pat. No. 5,129,846 issued to Berge A. Dimijian on Jul. 14, 1992, discloses a vessel propulsion system having four control water port locations around the hull of the boat. Two of the water port locations are in the stern of the boat and two are in the bow of the boat. Each of the four ports may either discharge water under pressure or conversely provide suction as an inlet to water. Thus, each of the four water outlet locations can provide a forward thrust or a rearward thrust. Control of the four locations as well as the direction of water flow is by selectively controlling the valves to cause the water jetting in the appropriate direction. There is no direct teaching of coordinated steering between the main steering and control of the vessel and the maneuvering for docking.

SUMMARY OF THE INVENTION

Therefore, it is a primary object of the invention to provide a simple and efficient marine vessel maneuvering and propulsion system. This and other objects are achieved by the present invention which includes a water jet propelled marine vessel having a water turbine driven by a power source. The water turbine has a water jet outlet for providing propulsion. A waterjet receiving chamber is connected to the jet outlet and receives a flow of water under pressure. A forward thrust nozzle is in fluid connection with the water jet chamber for providing forward thrust to the marine vessel when water under pressure leaves the thrust nozzle. The first end of a water conduit is in fluid connection with the water jet receiving chamber and the second end of the conduit is fluidly connected to a manifold for receiving the flow of water under pressure. The fluid manifold will have at least four, and preferably six, outlet ports. A reverse gate is mounted at the exhaust outlet of the forward thrust nozzle for movement between a full open position and a closed position such that water under pressure will be delivered through the forward thrust nozzle when the gate is in the full open position and will be delivered to the first end of the water conduit when the reverse gate is in a position other than full open. A plurality of fluid conduits are connected one each to the manifold ports and are routed to selected positions around the hull of the marine vessel where they terminate in exhaust ends. A single cylinder valve cooperates with the manifold having at least four ports such that simple sliding controlled movement of the cylinder opens and closes selected ones of the ports so that water under pressure is exhausted from the exhaust ends of selected ones of the plurality of fluid conduits. There is also included a steering mechanism which can move the cylinder to provide selected movement of the marine vessel. In addition to controlling the single cylinder valve, during precise movement, the steering mechanism also controls the direction of the main thruster nozzle for normal steering control during operation of the vessel.

BRIEF DESCRIPTION OF THE DRAWINGS

These and other features of the present invention will be more fully disclosed when taken in conjunction with the following Detailed Description of the Preferred Embodiment(s) in which like numerals represent like elements and in which.

DETAILED DESCRIPTION OF THE PREFERRED EMBODIMENT(S)

Figure 1:
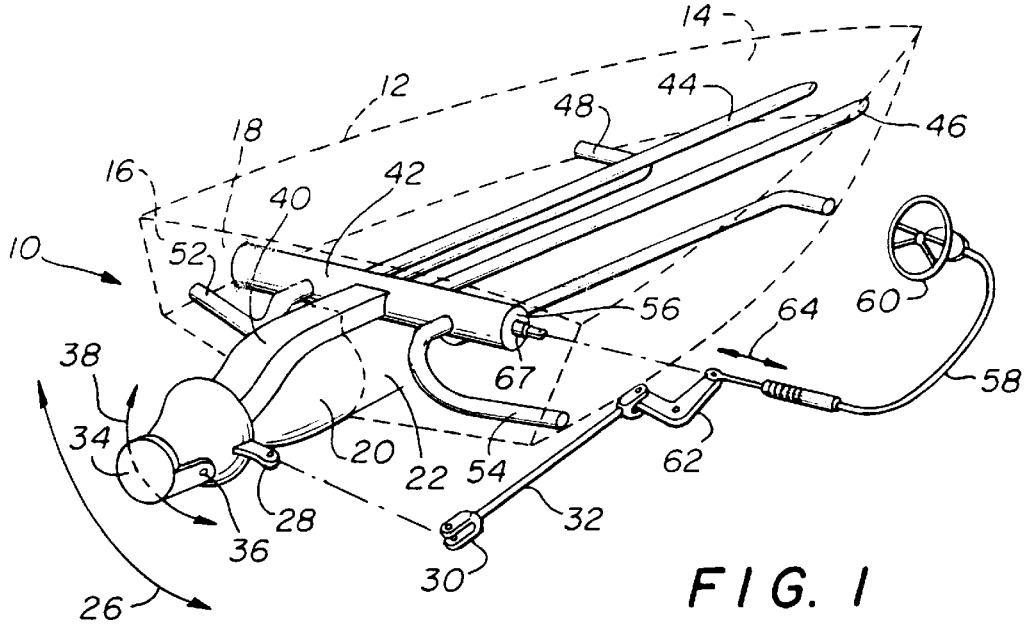
FIG. 1 is a prospective and schematic view of the novel water jet propulsion and maneuvering system of the present invention.

Referring now to FIG. 1, there is shown generally at 10 the marine propulsion system of this invention as it might be mounted in the hull of a boat 12 shown in phantom lines. As shown, the boat 12 includes a bow 14 and a stern portion 16. Mounted at the stern 16 and through the transom 18 is the turbine and water thruster portion 20 of the water propulsion system. The turbine portion 20 is driven by a suitable marine engine such as a gasoline diesel or other internal combustion engine partially seen at 22. Mounted to the exhaust end of the turbine 20 is a pivotal thruster nozzle 24 which is suitable for pivoting in a starboard and port direction as indicated by double headed arcuate arrow 26. Mounted to thruster nozzle 24 is a control lever arm 28 suitable for connecting to a yoke portion 30 of a control arm 32 to be discussed hereinafter. Covering the end of thruster nozzle 24 is a water reverse gate 34 pivotally mounted to the thruster nozzle 24 at pivot points 36. As shown, the reverse gate 34 may be rotated in an upward and downward motion as indicated by double headed arcuate arrow 38. A water flow conduit 40 leads from the pivotal thruster nozzle 24 to a water manifold 42. As will be discussed later, water manifold 42 includes a series of ports or outlets. Connected to the ports or outlets are a plurality of water conduits which lead to various exhaust ports located at various positions around the hull of boat 12. In the embodiment shown in FIG. 1, there are six conduits as follows. A first pair of conduits 44 and 46 extend to the bow of the boat and exhaust in a forward direction as shown. Alternately, a single conduit could extend to the bow of the boat at the center line. Also included are a pair of conduits 48 and 50 which also extend to the bow of the boat 14 but are routed so as to discharge in a port or starboard direction with reference to the center line of the vessel. Finally, there are also a pair of water conduits 52 and 54 which exhaust in port and starboard directions respectively, located at the stern portion 16 of the boat. Working in a coordinate fashion with the water manifold 42 is a sliding water valve member 56 which has a water-tight sliding fit with manifold 42 and as will be discussed later moves back and forth to selectively uncover various of the manifold ports so as to provide a fluid path to the various water delivery conduits around the parameter of the boat. Connected to sliding water valve 56 is a cable means 58 controlled by steering wheel 60 located in the cockpit of the boat. As was discussed earlier, cable means 58 also controls the main thruster nozzle 24 by means of a linkage 62 connected to the other end of the control rod 32. It should be understood at this point, that movement of the steering wheel 60 results in movement of the cable 58 in a direction indicated by double headed arrow 64 such that movement of water slide valve 56 and thruster nozzle 24 are coordinated. It should also be appreciated that instead of a mechanical cable linkage as shown, coordinated control of main thruster nozzle 24 and sliding water valve 56 could be by an electrical or hydraulic actuator.

Figure 2A:
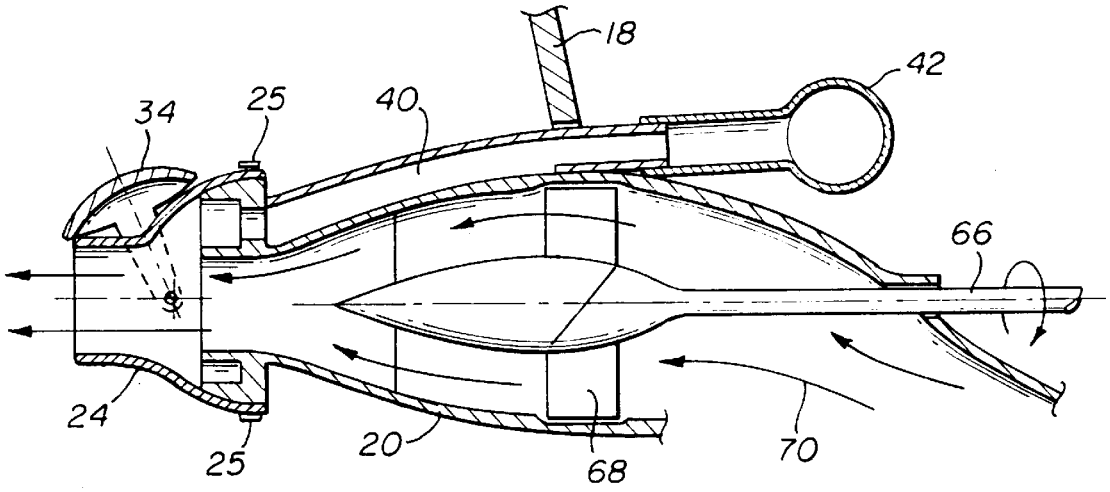
FIGS. 2A and 2B are simplified cross-sectional views of the water jet engine showing the water flow with the water gate in the full open or full closed positions.
Figure 2B:
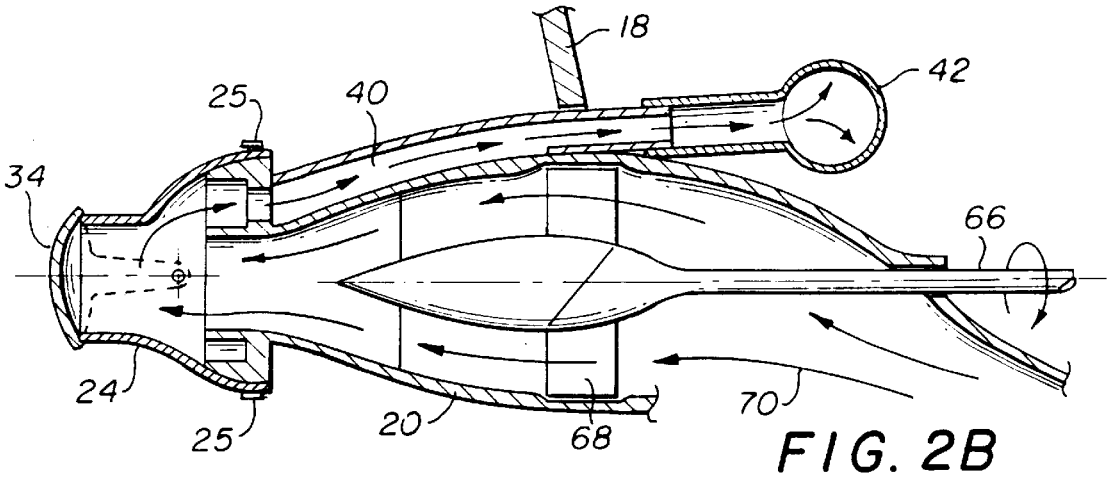

Referring now to FIGS. 2A and 2B, operation of the main propulsion system of the vessel will be discussed. It will be appreciated that common elements already shown in FIG. 1 will bear the same reference numerals in FIGS. 2A and 2B as well as the remaining figures which will be discussed later. As shown, the primary vessel power source drives a shaft 66 which in turns rotates the turbine blades such as turbine blade 68. As will be appreciated, rotation of the turbine blades results in a flow of water indicated by the arrows 70 typically from the underneath side of the boat through a grated opening. As shown in FIG. 2A, when the reverse gate 34 is in the full open position the water flow is through the exhaust end of turbine 20 and into and then out of thrust nozzle 24. When the reverse gate is in this position, directional control of the boat is achieved by pivotal motion of the thrust nozzle 24 around pivot points 25. Thus, pivoting of the thrust nozzle 24 in the directions indicated by arcuate angle 26 as discussed above, results in directional control of the vessel.

Referring now to FIG. 2B, water gate 34 is shown in the fully closed position. When the water gate 34 is closed as shown, the water cannot be exhausted through the thrust nozzle 24 and consequently is diverted into the water conduit 48 and consequently past the transom 18 and into the water manifold 42. Thus, water under pressure is delivered to the water manifold 42 which cooperates with the sliding water valve member 56. Sliding water valve 56 has a water-tight sliding fit with the inside of manifold 42.

Although the reverse water gate 34 is shown in the full closed position in FIG. 2B, it will be appreciated that the water gate could be positioned at an intermediate position between fully closed and fully open. In such an event, a portion of the water would still be exhausted through the thrust nozzle 24 to provide the boat with forward direction while a portion of the water would be diverted to the manifold 42 to provide additional maneuvering and steering in the forward direction.

Figure 3A:
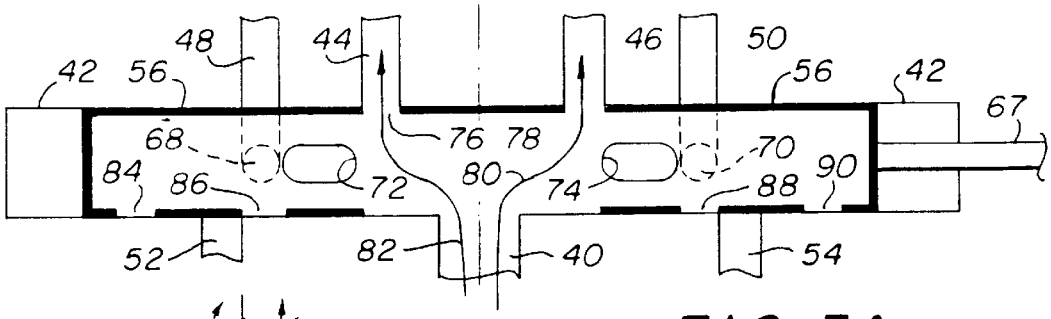
FIGS. 3A, 3B, and 3C; 4A, 4B, and 4C; 5A, 5B, and 5C; 6A, 6B, and 6C; and 7A, 7B, and 7C are diagrammatic views showing the single slide manifold water valve in selected positions and the resulting water flow direction in response to various positions of the marine vessel steering wheel.
Figure 3B:
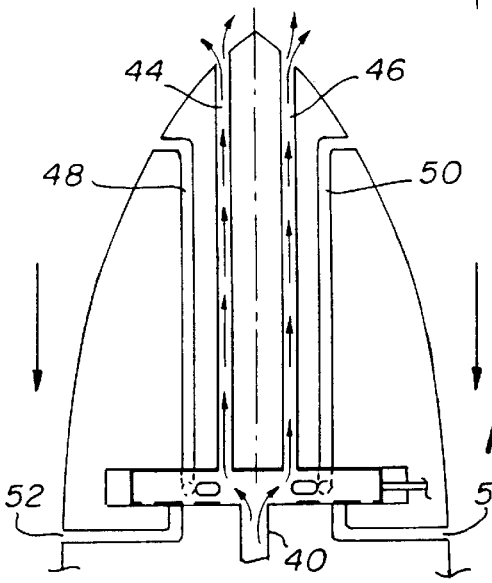
Figure 3C:
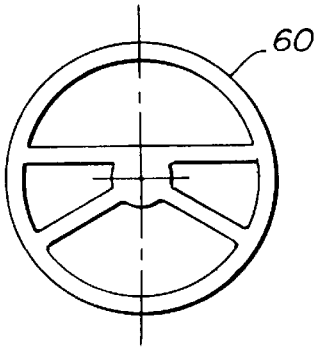

Referring now to FIGS. 3A, 3B, and 3C; 4A, 4B, and 4C; 5A, 5B, and 5C; 6A, 6B, and 6C; and 7A, 7B, and 7C, there are shown diagrammatic representations of the flow of water for the jet thrusters depending upon the coordinated positions of the steering wheels and the sliding water valve.

Referring now to FIG. 3A, 3B, and 3C, it will be appreciated that the reverse gate 34 will be in the closed position such that water is received into manifold 42 from the water conduit 48. As shown, a sliding valve 56 is connected to a control rod 67 which in turn is connected to the cable 58 as discussed hereto above. It will be appreciated that movement of the cable 58 in a direction indicated by arrow 64 will also move the sliding valve 56 in a reciprocating manner. As shown diagramatically, in addition to the inlet conduct 48 for receiving the pressurized water flow, the manifold 42 is shown as being connected as discussed above to the two forward thruster conduits 44 and 46 which go to the bow of the boat for providing reverse thrust. Also as was discussed above, instead of two reverse thrust conduits, a single conduit with an exhaust on the center line at the front of the boat could be used. Likewise, as was discussed, the bow of the boat also includes two exhaust nozzles from conduits 48 and 50 for providing port and starboard motion respectively. In the diagram shown, the port 68 and 70 connected to the conduits 48 and 50 are shown exiting from the bottom of the water manifold 42 as indicated by the dotted lines. Likewise, the water conduits 52 and 54 which are exhausted at the port and starboard areas of the stern of the boat also exit from manifold 42. Likewise, sliding valve 56 includes two elongated ports 72 and 74 which cooperate with the ports 68 and 70, respectively of the water manifold. In the diagram of FIG. 3A, the exit ports 68 and 70 of the water manifold are still covered by sliding valve 56 as the ports 72 and 74 are not in registration. However, it can be seen that ports 76 and 78 are in registration with the ports leading to conduits 44 and 46 such that there is fluid connection from the inside of the sliding water valve 56 to the ports. Thus, it will be appreciated that water flow as indicated by the arrows 80 and 82 enters through the conduit 48 into the water valve 56. The water then exits through ports 76 and 78 in the sliding water valve which are in registration with the conduits 44 and 46, respectively. Thus, as shown in FIG. 3B, water flows from the inlet conduit 40 into the manifold and water valve and then through ports 76 and 78 of the water valve and out the ports of the manifold which are connected with the forward traveling conduits 44 and 46. Thus, it will be appreciated that, when the valve is in this position, water is delivered to the bow of the boat which, in turn, creates reverse motion. It should also be noted that in addition to the ports already discussed, sliding valve 56 further includes ports 84 and 86 which cooperate with a port in the water manifold 56 which is connected to the conduit 52 going to the port stern jet exhaust location. Likewise, ports 88 and 90 in water valve 56 are located so that they cooperate with the port in the water manifold 56 which cooperates with the water conduit 54 which exhausts at the starboard side of the stern portion of the boat. As shown, during reverse motion of the boat, it will be appreciated that there is no registration of either the port 84 or 86 with the conduit 52, nor is there registration with the ports 88 or 90 with the conduit 54. These ports come into play later as will be discussed hereinafter. Thus, as can be seen, for reverse motion of the boat, the water valve 56 is shown in a central position such that water only goes to the forward exhausting conduits. This is further indicated by the position of steering wheel 60 which is shown in a neutral position.

Figure 4A:
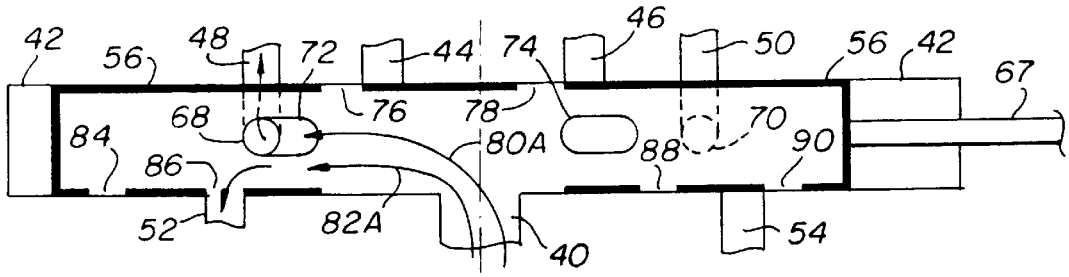
Figure 4B:
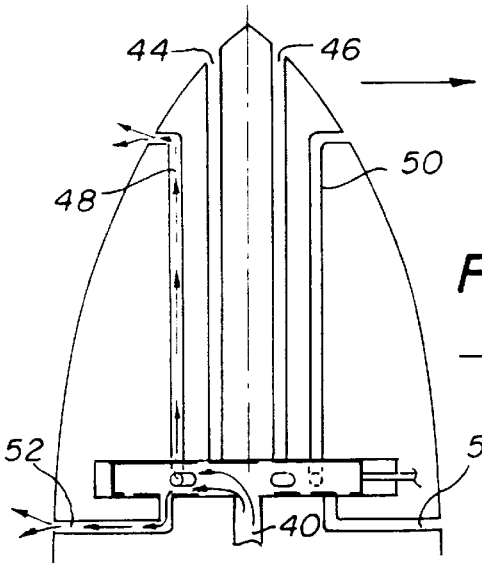
Figure 4C:
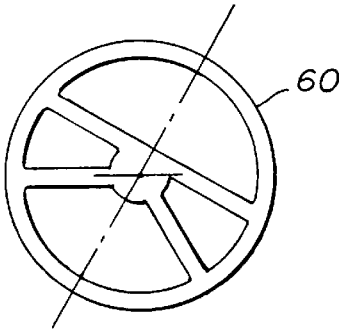

Referring now to FIGS. 4A, 4B, and 4C, the position of the sliding valve 56 is shown with respect to manifold 42 and the resulting water flow when steering wheel 92 is rotated slightly clockwise. As shown, rotation of the steering wheel will force the control cable 58 to move the control rod 67 of sliding water valve 56 in a leftward position as shown in the drawing. This motion to the left will result in the ports 76 and 78 of the water valve moving out of registration with the conduits 44 and 46, thereby cutting off the exhaust waterjet from the bow of the boat. Likewise, none of the ports 74, 88, or 90 on the right side of the sliding water valve 56 are in registration with any of the ports in the water manifold. However, the elongated port 72 is now in registration with the port 68 which leads to the port bow thruster conduit 48. Likewise, port 86 of the sliding valve 56 is now in registration with the port connected to the port stern thruster conduit 52. Thus, the water flow indicated by arrows 80A and 82A now shows water flowing to the conduit 48 and the conduit 52. Such water flow will provide a starboard or movement to the right of the marine vessel.

Figure 5A:
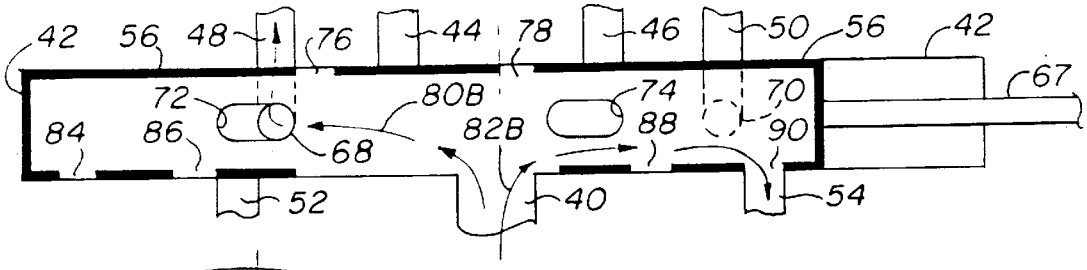
Figure 5B:
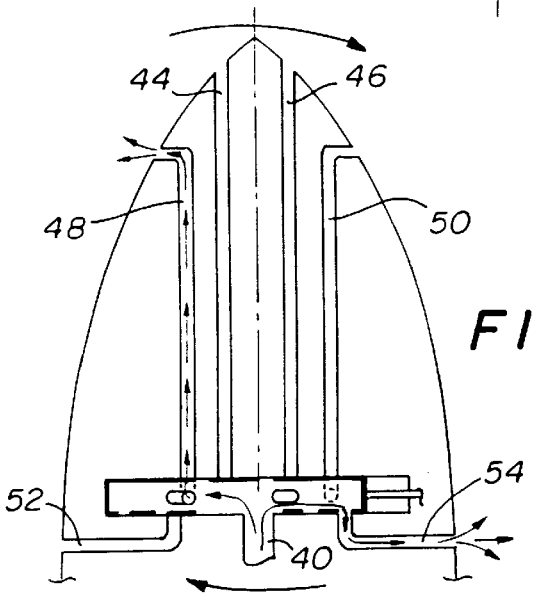
Figure 5C:
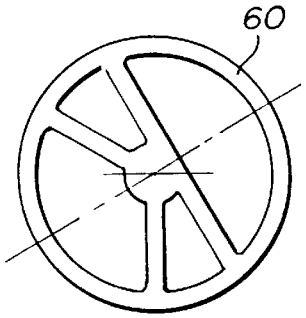
Figure 6A:
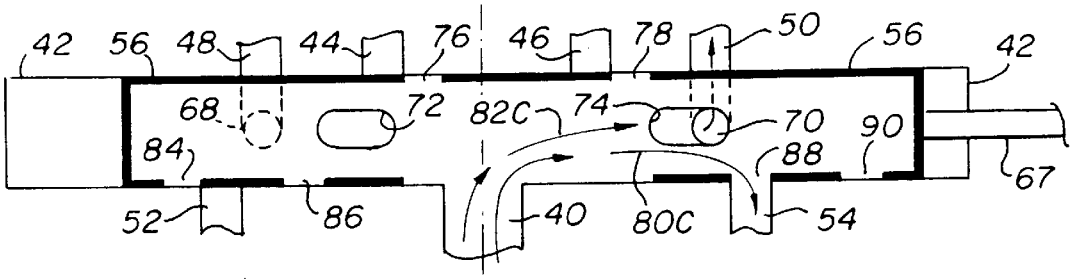
Figure 6B:
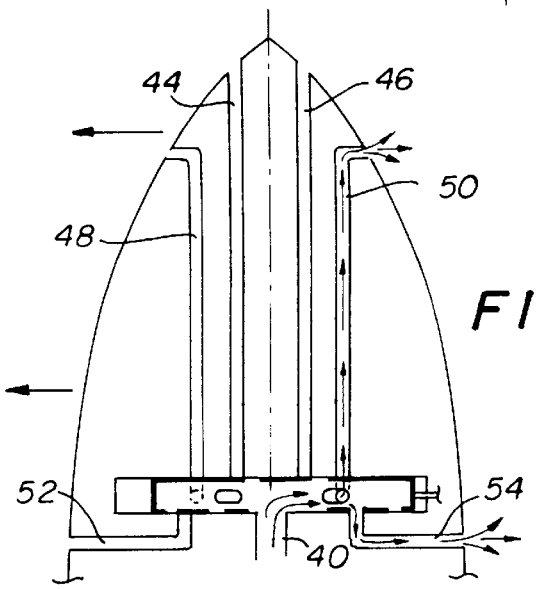
Figure 6C:
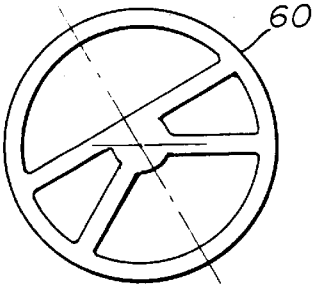
Figure 7A:
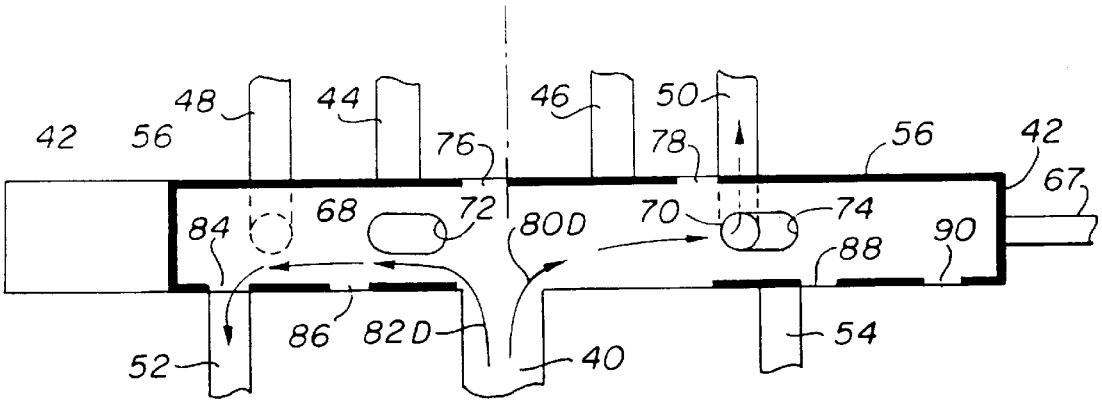
Figure 7B:
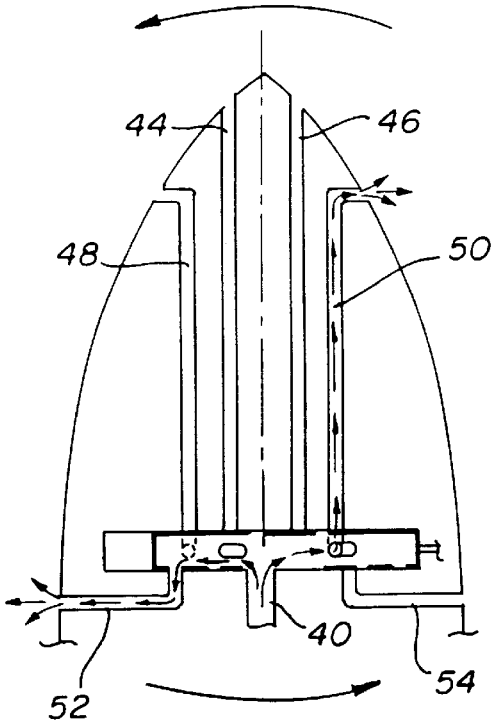
Figure 7C:
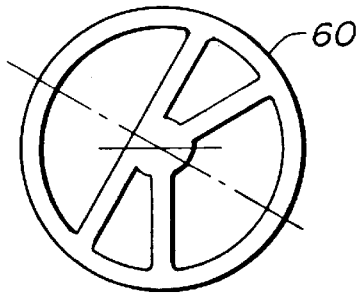

Referring now to FIGS. 5A, 5B, and 5C, the position of the water valve and the water flow is shown with respect to increased clockwise motion of steering wheel 92. With such motion, it will be seen that sliding valve 56 has moved further to the left as indicated in drawing 5C. Further, as shown the conduits 44 and 46, which are routed to the bow of the boat for reverse movement, are still closed, such that no water flows in these conduits. Further, the elongated port 72 of sliding water valve 56 remains in registration with port 68 connected to the port bow thruster conduit such that water flow continues to flow from the port bow exhaust. However, the movement of the sliding water valve 56 has resulted in the water valve port 86, which was in registration with the manifold port connected to conduit 52, to move such that it is now out of registration and no water flows into conduit 52. However, referring to the right side of the diagram, it can be seen that the water valve port 90 is now in registration with the manifold port connected to conduit 54 which travels to the starboard stern portion of the boat. Thus, as shown by the water arrow 82B, water does now travel out of the conduit 54 and to the exhaust port on the rear starboard portion of the boat. Thus, it will be appreciated with water flow through the thruster nozzles as shown, the boat will tend to pivot in a clockwise direction.

FIGS. 6A, 6B, and 6C, and 7A, 7B, and 7C, operate substantially in the same manner but in reverse to that discussed with respect to FIGS. 4A, 4B, and 4C and 5A, 5B, and 5C. Thus, it will be appreciated that, when the valve is in the position shown in 6C, there will be port movement of the boat that is in a left direction and, when the valves are in the position 7C, there will be counterclockwise pivoting or rotation of the boat.

The corresponding structures, materials, acts, and equivalents of all means or step plus function elements in the claims below are intended to include any structure, material, or act for performing the function in combination with other claimed elements as specifically claimed.

What is claimed is:

1. In a water jet propelled marine vessel having a water turbine driven by a engine or other power source and having a water jet outlet, a reversing and control water jet propulsion system comprising:

a water jet exhaust chamber connected to said water jet outlet for receiving a flow of water under pressure;

a forward thrust nozzle in fluid communication with said water jet exhaust chamber for providing forward thrust to said marine vessel when water under pressure is delivered therefrom;

a water conduit having a first end and a second end, said first end in fluid communication with said water jet exhaust chamber;

a reverse gate for movement between a full open position and a closed position such that water under pressure is delivered through said forward thrust nozzle when said gate is in said full open position, and such that water under pressure is delivered to said first end of said water conduit when said reverse gate is in a position other than full open;

a manifold fluidly connected to said second end of said conduit for receiving a flow of water under pressure, said manifold having at least four outlet ports;

a plurality of fluid conduits, each of said plurality of fluid conduits having a first end connected one each to said at least four outlet manifold ports, and an exhaust end selectively positioned around the hull of said marine vessel;

a single cylinder valve cooperating with said at least four manifold ports such that controlled movement of said cylinder valve opens and closes selected ones of said plurality of ports and such that water under pressure is exhausted from said exhaust end of selected ones of said plurality of fluid conduits; and actuating mechanism to controllably move said sliding cylinder water valve to provide selected movement of said marine vessel.

2. The propulsion system of claim 1 having exhaust ports positioned such that said marine vessel can move to port or starboard without forward motion and can pivot clockwise and counterclockwise.

3. The propulsion system of claim 2 wherein said at least four ports include at least five ports, said fifth port positioned at the bow of the marine vessel such that said marine vessel can also move in a rearward direction.

4. The propulsion system of claim 1 wherein said forward thrust nozzle is pivotally mounted to said water jet exhaust chamber to provide directional control as said marine vessel moves in a forward direction.

5. The propulsion system of claim 4 wherein said actuating mechanism is also connected to said pivotable thrust nozzle such that movement of said pivotable thrust nozzle and said sliding cylinder valve are coordinated.

6. The propulsion system of claim 1 wherein said at least four ports are six ports and where there are at least two ports at the bow of said marine vessel for providing reverse thrust.

7. The marine vessel of claim 1 wherein said activating mechanism includes a steering wheel connected to linkage apparatus which in turn is connected to said sliding water valve.

8. The propulsion system of claim 5 wherein said control linkage is connected between said steering wheel and both said cylinder valve and said pivoting thrust nozzle such that movement of said steering wheel changes the direction of said marine vessel.

9. The propulsion system of claim 7 wherein said control linkage is hydraulic.

10. The propulsion system of claim 7 wherein said control linkage is electrical.

11. The apparatus of claim 1 wherein said water valve slides within said water manifold with a sliding fit to provide registration of selected ports in said water valve with selected ports in said water manifold.

12. The propulsion system of claim 11 having exhaust ports positioned such that said marine vessel can move to port or starboard without forward motion and can pivot clockwise and counterclockwise.

13. The propulsion system of claim 12 wherein said at least four ports include at least five ports, said fifth port positioned at the bow of the marine vessel such that said marine vessel can also move in a rearward direction.

14. The propulsion system of claim 11 wherein said forward thrust nozzle is pivotally mounted to said water jet exhaust chamber to provide directional control as said marine vessel moves in a forward direction.

15. The propulsion system of claim 14 wherein said actuating mechanism is also connected to said pivotable thrust nozzle such that movement of said pivotable thrust nozzle and said sliding cylinder valve are coordinated.

16. The propulsion system of claim 11 wherein said at least four ports are six ports and where there are at least two ports at the bow of said marine vessel for providing reverse thrust.

17. The marine vessel of claim 11 wherein said activating mechanism includes a steering wheel connected to linkage apparatus which in turn is connected to said sliding water valve.

18. The propulsion system of claim 15 wherein said control linkage is connected between said steering wheel and both said cylinder valve and said pivoting thrust nozzle such that movement of said steering wheel changes the direction of said marine vessel.

19. The propulsion system of claim 17 wherein said control linkage is hydraulic.

20. The propulsion system of claim 17 wherein said control linkage is electrical.

* * * * *